United States Patent [19]

Chamberlin

[11] 4,125,299

[45] Nov. 14, 1978

[54] FILE DIVIDER AND INDEXING APPARATUS

[75] Inventor: Coleman R. Chamberlin, Thompson Ridge, N.Y.

[73] Assignee: CEL-U-DEX Corp., New Windsor, N.Y.

[21] Appl. No.: 801,412

[22] Filed: May 27, 1977

[51] Int. Cl.[2] ..... A47B 63/00

[52] U.S. Cl. ..... 312/184; 312/312; 211/50; 211/184; 220/22

[58] Field of Search ..... 312/184, 312, 183; 211/184, 50; 220/22

[56] References Cited

U.S. PATENT DOCUMENTS

| | | | |
|---|---|---|---|
| 923,412 | 6/1909 | Dannheiser | 312/184 |
| 1,712,168 | 5/1929 | Rand, Jr. | 220/22 |
| 1,829,588 | 10/1931 | Forsyth | 211/184 |
| 1,882,457 | 10/1932 | Straubel | 220/22 |
| 1,918,765 | 7/1933 | Lombardini | 220/22 |
| 2,083,050 | 6/1937 | Chamberlin et al. | 211/184 |
| 2,927,697 | 3/1960 | Hoover | 211/50 |
| 3,269,547 | 8/1966 | Chamberlin | 211/184 |
| 3,314,177 | 4/1967 | Mies, Jr. et al. | 211/50 |
| 3,399,429 | 9/1968 | Goodman | 211/50 |
| 3,669,278 | 6/1972 | Heroy | 211/184 |

FOREIGN PATENT DOCUMENTS

| | | | |
|---|---|---|---|
| 900,329 | 7/1949 | Fed. Rep. of Germany | 312/184 |

*Primary Examiner*—Victor N. Sakran

*Attorney, Agent, or Firm*—Sprung, Felfe, Horn, Lynch & Kramer

[57] ABSTRACT

In a preferred embodiment, an upright divider and support element is provided by an elongated wire backing having attached to the top wire a metal index tab adapted to carry a securely-held insert for noting data thereon pertaining to whatever is stored in various folders or files supported by the elongated wire backing which wire backing has an integral and continuous wire base forming centrally thereof and spaced-away from the upright divider and support element, a wire portion forming a downwardly-extending U-shaped structure which is inserted through an opening in a base plate structure, and locked when inserted through the opening, by a pin key or pin locking-element inserted through the U-shaped structure beneath the underside of the plate structure.

8 Claims, 7 Drawing Figures

FILE DIVIDER AND INDEXING APPARATUS

This invention relates to an apparatus serving dual purposes of divider-support and indexing functions concurrently, for use in file drawers.

BACKGROUND TO THE INVENTION

Prior to the present invention, applicant has been a manufacturer and seller of divider-support structures for file cabinet drawers, and the supports have always been directed to solely the function of dividing and supporting one or more files from adjacent file drawer space for use by other material. Accordingly, consistent with being preferably heretofore unnoticeable as to its presence, except for the good performance in maintaining the file material supported in an upright and proper state, the upright supporting element has been relatively short, the top thereof being well below the top of normal files; together with serving no function to be longer, such longer support would be normally an interference in handling files, and unsightly, and the additional material thereof more expensive.

For indexing purposes heretofore, normally separate insert members have been utilized, or alternately merely labeling has been placed on the files (folders) themselves.

SUMMARY OF THE INVENTION

Accordingly, objects of the present invention are to provide office equipment providing multiple functions equally well and concurrently, thereby reducing otherwise required office total inventory and storage, and providing a more neat and orderly file drawer, at overall reduced cost to the consumer with the concurrent novel advantages thereof.

Another object is to eliminate the need for separate index cards.

Since index cards themselves normally also tend to slide-down into the drawer to a point not discernible of information carried thereon, another object is to overcome and avoid this problem.

Another object is to achieve concurrently multiple functions of divider-support and indexing of the filed material, folders, or the like.

Another object is to improve indexing equipment for file drawers.

Other objects become apparent from the preceding and following disclosure.

Objects of the invention are obtained by embodiment typically illustrated herein but not intended to limit the invention necessarily to such illustrated embodiment being merely for purposes of improved understanding of the invention which includes variations and modifications apparent to persons skilled in this particular art.

Broadly the invention may be described as a file divider and indexing combination which includes an upright divider and support element, an anchoring mechanism, and an indicia-mounting mechanism. The upright divider and support element is of a width sufficient to support spaced-apart points of file material such as a file folder, typically, and has a necessary height higher than normal file folder's heights, such that the indicia-mounting mechanism mounted on the upper portion thereof is discernably visible above upper edges of normal file folders when the attached anchor mechanism provides essential support to the upright divider to provide needed support to file material. Accordingly, both the index indicia may be always easily read, not slipped sidewardly nor downwardly into lower depths between the files or folders, and concurrently the files or folders themselves are maintained supported in the upstanding proper position.

In various preferred embodiments, the indicia-mounting mechanism includes one or more partially enveloping (enclosing) structure open at either or both ends thereof for easy insertion and/or removal of an insert carrying indicia information such as name or number or other classification or indexing material, as the case may be; or further may be in the form of or including a metal tab mounted on a metal upright divider and support element typically by soldering thereto, or alternately appropriately clamped thereon.

The upright divider and support element is more preferably of substantially rigid wire or the like, and also preferably has the anchor mechanism as an integral part thereof extending substantially horizontally from the base of the upright divider and support element, and having as a part of the anchor wire at least one downwardly-extending U-shaped structure, and for coordinated use therewith as a further part of the anchor mechanism a plate structure having an opening therein for receiving therethrough the U-shaped structure for the pinning thereof by a locking element in the nature typically of a pin or the like for insertion beneath the underside face of the plate structure. The downwardly-extending U-shaped structure — at least one thereof, is positioned away from the base of the upright divider and support element and about centrally thereof, for improved leverage and balance in locking the upright divider and support element and the index mechanisms thereon in the proper upright state.

In another preferred embodiment, there is provided an insert securely and fixedly held by the metal tab for the transcribing on information thereonto.

The invention may be better understood by making reference to the following figures.

THE FIGURES

DETAILED DESCRIPTION OF THE INVENTION

Figure 1:
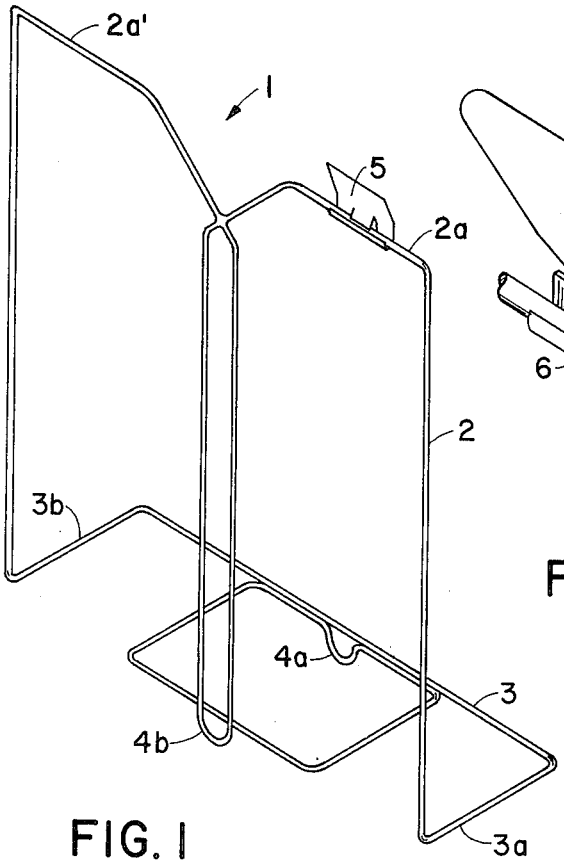
FIG. 1 illustrates a side and rear perspective view of a preferred file divider and indesing device of the invention.
Figure 1A:
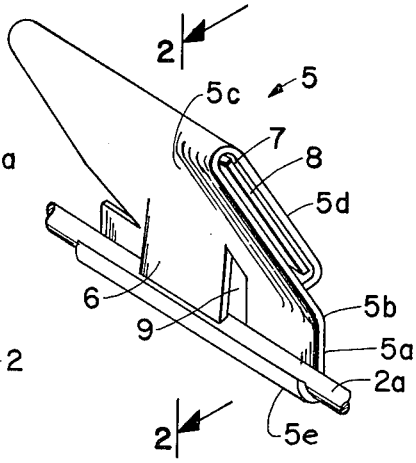
FIG. 1A illustrate an enlarged in-part view of FIG. 1, showing the metal tab and the portion of the upright divider and support element on which it is mounted, in a side and rear perspective view.
Figure 2:
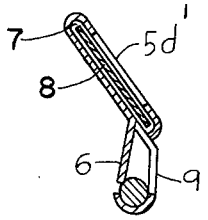
FIG. 2 illustrates a cross-sectional view as taken along lines 2—2 of FIG. 1A.
Figure 2A:
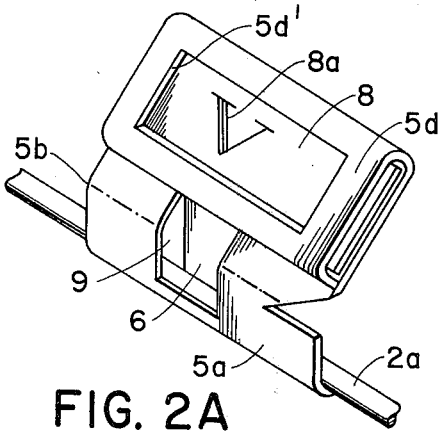
FIG. 2A illustrates a front perspective view of the FIG. 2-illustrated mounted metal tab.
Figure 3:
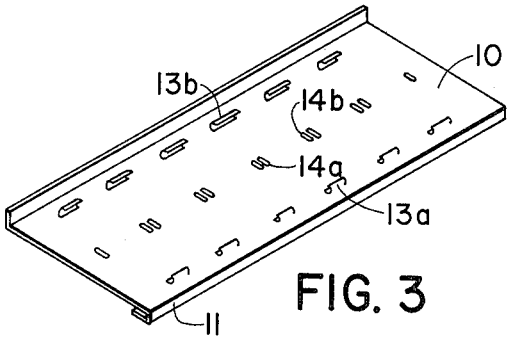
FIG. 3 illustrates a top perspective view of a plate structure onto which the embodiment of FIG. 1 is a mountable.
Figure 5:
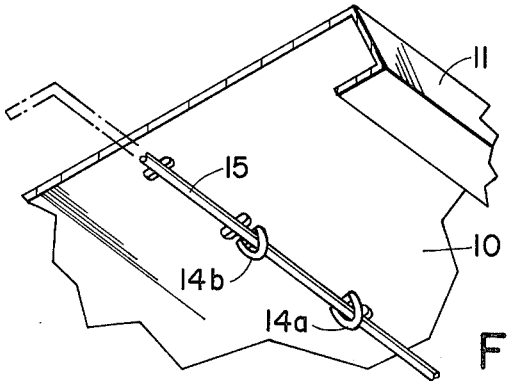
FIG. 5 illustrates an in-part and bottom perspective view of the FIG. 4 embodiment, illustrates the locking mechanism.

The embodiment of FIG. 1 is further illustrated in FIGS. 1A, 2, 2A, 4 and 5, and accordingly these Figures may be referred to in the following description thereof. In like manner, the plate structure and the locking mechanism respectively associated therewith, are illustrated in FIGS. 3, 4, and 5 and may be referred to in the description thereof.

Accordingly, there is an upright divider and support element 1 including a plurality of upright support rigid wires 2 and cross-support wires 2a' and 2a, with the metal tab device 5 mounted on the cross-support 2a. The upright divider and support element plurality of upright support rigid wires 2 are rigidly connected to and supported uprightly by the horizontal anchor wires 3, 3a, 3b, 4, 4a, and 4b, the portions 4a and 4b being downwardly-extending U-shaped locking structures.

The metal tab device 5 includes an insert portion having back plate 5c and front plate 5d forming an insert space 7 for inserting an insert indicia card 8 therein, with a plate base upright portion 5a bent rearwardly at bend point 5b, and hook portion 5e fastened around the cross-support 2a and secured by each of the clamp 6 and solder. The forward or front plate 5d has window 5d' therein through which the indicia 8a — namely a "V", may be seen on the indicia card 8. The clamp is formed by cutting a window (cut-out) 9 to form clamp 6 which hangs downwardly from the rearwardly bent back plate, 5c, such that the grasping action thereof is enhanced.

Figure 4:
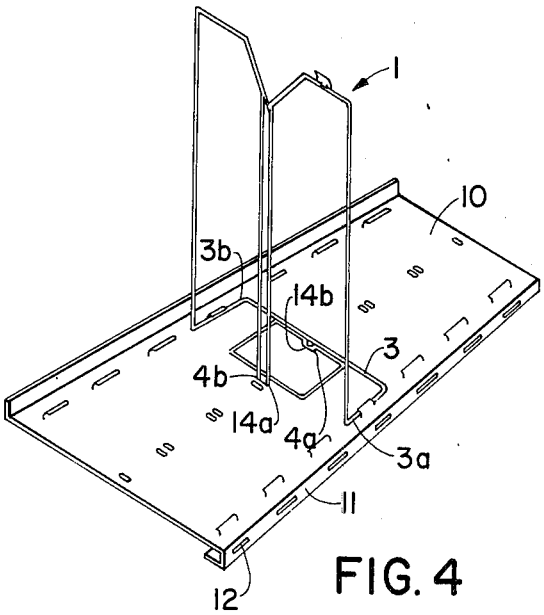
FIG. 4 illustrates a further front and top perspective view of the embodiment of FIG. 3, together with the FIG. 1 embodiment mounted thereon.

The plate structure 10 has downwardly extending and squared flange 11, and has U-lock structure-receiving pairs of forward aperature 14b into which forward U-shaped locking structure 4a is inserted and rearward aperature 14a into which rearward U-shaped locking structure 4b is inserted, as shown in FIG. 4, and as shown in a locked state by threaded and inserted pin locking-element 15 is inserted. The overhanging elements 13a and 13b also serve to secure the horizontal anchor wires 3a and 3b, also substantially rigid wires.

On some occasions, the plate may be advantageously used to support books uprightly, and in such instance it is advantageous to have labels 12 on the vertical face of the flange 11.

It is within the scope of the invention to make variations and modifications and substitution of equivalents as obvious to a person of ordinary skill.

I claim:

1. File divider and indexing device comprising in combination: an upright divider and support element adapted to provide support over a predetermined wide area sufficiently to lend support to each of spaced-apart points of a file folder, and base anchor means attached to a base portion of the divider and support element for maintaining the upright divider and support element in an upright state when the upright divider and support element is supporting file material; the upright divider and support element being of a predetermined height sufficient to exceed in height that of normal file folders while receiving upright support from the base anchor means; and indicia-mounting means for providing information relative to file material being supported, and mounted on an upper portion of the upright divider and support element such that indicia thereof is visible above the upper edges of normal file folders.

2. File divider and indexing device of claim 1, in which the indicia-mounting means comprises at-least partially enveloping structure open at-least one end thereof adapted to receive an insert for carrying indicia information.

3. File divider and indexing device of claim 2, in which the indicia-mounting means' at-least partially enveloping structure includes a metal tab, and in which the upright divider and support element is substantially of metal, and the metal tab is fixedly bound onto an upper edge of the metal of the upright divider and support element.

4. File divider and indexing device of claim 3, in which the upright divider and support element is metallic wire substantially rigid in structure.

5. File divider and indexing device of claim 4, in which said anchor means includes a first wire structure providing at-least one downwardly-extending U-shaped structure, a second plate structure having an opening therein receivable of the first wire structure's downwardly-extending U-shaped structure, and a pin locking-element insertable beneath a lower face of the second plate structure through the one downwardly-extending U-shaped structure when received through the second plate structure's opening.

6. File divider and indexing device of claim 5, in which the metal tab contains a securely-held insert for noting data thereon.

7. File divider and indexing device of claim 3, in which the metal tab contains a securely-held insert for noting data thereon.

8. File divider and indexing device of claim 7, in which said one downwardly-extending U-shaped structure is spaced-away from the upright divider and support element and is positioned substantially centrally relative to a width of said upright divider and support element.

* * * * *